US005827582A

United States Patent [19]

Quadir et al.

[11] Patent Number: 5,827,582

[45] Date of Patent: Oct. 27, 1998

[54] OBJECT WITH A SMALL ORIFICE AND METHOD OF MAKING THE SAME

[75] Inventors: Tariq Quadir, Simpsonville; Gary E. Del Regno, Laurens, both of S.C.

[73] Assignees: CeramTec North America Innovative; Ceramic Engineering Corporation, both of Laurens, S.C.

[21] Appl. No.: 751,176

[22] Filed: Nov. 15, 1996

[51] Int. Cl.[6] ..... B28B 5/00

[52] U.S. Cl. ..... 428/34.4; 425/72.2; 425/382.2

[58] Field of Search ..... 428/34.4; 425/72.2, 425/382.2

[56] References Cited

U.S. PATENT DOCUMENTS

| | | | |
|---|---|---|---|
| 3,213,337 | 10/1965 | Long | 317/234 |
| 3,389,215 | 6/1968 | Rice et al. | 174/152 |
| 3,858,914 | 1/1975 | Karie | 285/238 |
| 3,913,421 | 10/1975 | Hawkins | 29/470.5 |
| 4,050,915 | 9/1977 | Brown | 65/1 |
| 4,176,612 | 12/1979 | Speer | 110/323 |
| 4,421,947 | 12/1983 | Kyle | 174/152 |
| 4,425,476 | 1/1984 | Kyle | 174/152 |
| 4,518,820 | 5/1985 | Kyle | 174/152 |
| 4,579,703 | 4/1986 | Adlerborn et al. | 264/58 |
| 4,657,337 | 4/1987 | Kyle | 339/278 |
| 4,769,087 | 9/1988 | Wada | 156/85 |
| 4,791,992 | 12/1988 | Greenlee et al. | 166/387 |
| 5,160,676 | 11/1992 | Singh et al. | 264/60 |
| 5,308,556 | 5/1994 | Bagley | 264/13 |
| 5,370,596 | 12/1994 | Compagnon | 492/45 |
| 5,509,093 | 4/1996 | Miller | 385/27 |
| 5,548,675 | 8/1996 | Shigematsu | 385/80 |
| 5,563,973 | 10/1996 | Miller | 385/81 |
| 5,575,063 | 11/1996 | Hodan | 29/890.09 |
| 5,625,730 | 4/1997 | Ishikawa | 385/49 |

*Primary Examiner*—Paul R. Michl
*Attorney, Agent, or Firm*—Hardaway Law Firm P.A.

[57] ABSTRACT

An object with a small orifice has a highly precise orifice diameter which is produced prior to the firing of the object. A ferrule having an orifice is placed inside of a bore in a casing, preferably a ceramic casing. The casing is then shrunk around the ferrule, preferably by sintering, with the cross-sectional areas of both the ferrule and its orifice remaining constant during the shrinking step. Consequently, the ferrule is securely fixed within the casing without any gaps between the two. In an alternative method, the ferrule is pre-shrunk and placed inside the bore, where it expands to fill the bore.

28 Claims, 2 Drawing Sheets

OBJECT WITH A SMALL ORIFICE AND METHOD OF MAKING THE SAME

BACKGROUND OF THE INVENTION

This invention relates generally to the art of ceramics and more particularly to the art of producing objects with small orifices.

Various methods exist for producing objects with small orifices. U.S. Pat. No. 5,308,556 discloses a method of forming an extrusion die fabricated from sinterable ceramic or metal powders.

U.S. Pat. No. 4,769,097 shows a method whereby a member is fixed within a ceramic body. U.S. Pat. Nos. 3,389,215 and 3,213,337 involve sintering a ceramic with a metallic lead or electrode extending therethrough.

While the prior art devices may be suitable for their intended purposes, there is much room for improvement within the art of producing objects with small orifices.

SUMMARY OF THE INVENTION

It is therefore an object of the invention to produce an object having a highly precise orifice diameter.

It is a further object of the invention to produce an object with a highly precise orifice diameter which can be made in an inexpensive and easy manner.

It is a further object of the invention to produce an object that can have the orifice produced prior to firing of the ceramic body.

These and other objects of the invention are achieved by an object with a small orifice comprising a casing with a bore therethrough and a ferrule made from a material having a controlled cross-sectional area and defining an orifice therethrough, wherein the ferrule is fixedly secured within the bore. The method of producing the object comprises providing a casing defining a bore therethrough, providing a ferrule made from a material having a controlled cross-sectional area and defining an orifice therethrough, placing the ferrule in the bore, and shrinking the casing around the ferrule to securely fix the ferrule in the casing, whereby the size of the orifice remains constant throughout the step of shrinking.

DETAILED DESCRIPTION

According to this invention it has been found that objects with small orifices may be produced by first forming a ferrule with a small orifice and inserting one or more of such ferrules into an object to bond with that object upon further treatment. The following description will be given with particular emphasis to ceramic materials but the principle of the invention is applicable to a wide variety of material systems as which will become apparent from a reading of this disclosure with particular reference to the figures of drawing.

Producing objects with small orifices, such as spinnerets, requires a high degree of precise work because these objects are used in applications in which a precise amount of material flowing through an orifice within a specific tolerance of a specific size is required. Accordingly, objects with such small orifices are typically produced using highly precise methods such as micro-drilling or laser boring. However, these methods are expensive and can be cumbersome. These methods also produce rough surfaces in the capillary region. Furthermore, with ceramic spinnerets, the orifice must be made after firing of the ceramic because, otherwise, upon firing, the diameter of the orifice will shrink in a somewhat unpredictable manner. The present invention overcomes these deficiencies, as will be shown below.

Figure 1:
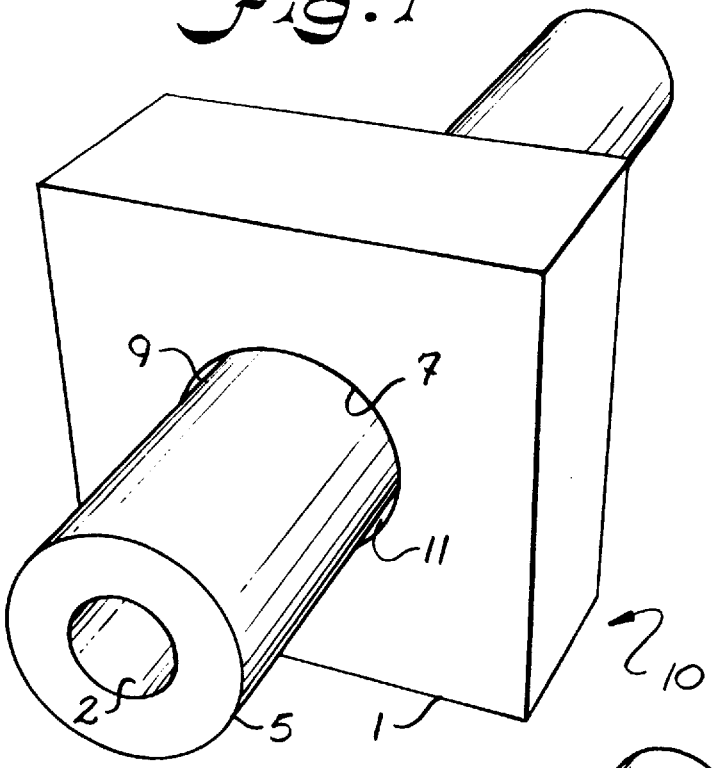
FIG. 1 is a perspective view of an object with a small orifice according to the invention before firing.

FIG. 1 shows the preferred embodiment of an object 10 having a small orifice. Object 10 comprises a ceramic blank or casing 1, which may be made from toughened zirconia, having a bore 11. Casing 1 may be green or partially sintered. Bore 11, which will usually be cylindrical, can be created by conventional methods, and is preferably in the center of casing 1. Because bore 11 will shrink during firing, its precise pre-firing dimensions are not critical. In the preferred embodiment, what is important is that the diameter of bore 11 (which is also the inner diameter of casing 1) is larger than the outer diameter of ferrule 5. This is necessary to allow for insertion of ferrule 5 into bore 11. However, the diameter of bore 11 should only be slightly larger than the outer diameter of ferrule 5, so that when bore 11 shrinks and then expands upon cooling it will secure ferrule 5 therein.

Ferrule 5, which will usually be cylindrical, has an outer diameter less than the diameter of bore 11. The outer diameter of ferrule 5 will vary depending on the application and is generally not critical. Ferrule 5 will usually have a uniform diameter, and thus a uniform cross-sectional area. Ferrule 5 defines an orifice 2 therethrough, which may be in the range of 60–200 $\mu$m ±1 $\mu$m, depending on the precise dimensions required for the particular application contemplated. Orifice 2 is preferably in the center of ferrule 5. Ferrule 5 is made from a pre-fired ceramic or nonceramic material having a controlled cross-sectional area, the latter preferably being made by extrusion. A material having a controlled cross-sectional area is a material whose cross-sectional area does not change during the step of shrinking the casing around the ferrule. The ferrule material may include, but is not limited to, lava, steel, titanium, tungsten, polycrystalline ceramics, glass, graphite, and plastic.

Ferrule 5 can have various aspect ratios. The aspect ratio is the length of the orifice divided by the diameter of the orifice. Without the process of this invention, it is practically impossible to produce objects with orifices having consistent and precise aspect ratios.

In the method of making an object with a small orifice according to this invention, ferrule 5 is placed in bore 11. Because bore 11 is larger than ferrule 5, a gap 9 surrounds ferrule 5. As discussed above, it is preferred that bore 11 is only slightly larger than ferrule 5, allowing for a friction fit of ferrule 5 within bore 11.

In an alternative embodiment of the present invention, ferrule 5 can be made from plastic. Note that if ferrule 5 is made from plastic, firing is not used. In order to pre-shrink ferrule 5, a process such as cooling and shrinking ferrule 5 in liquid nitrogen is used. The shrunken ferrule 5 is inserted into bore 11, where it expands to fill and become fixedly secure within bore 11 upon warming to room temperature. Bore 11, ferrule 5, and orifice 2 are of the appropriate size for allowing orifice 2 to return to its original size upon expanding and becoming fixedly secured within bore 11.

Figure 2:
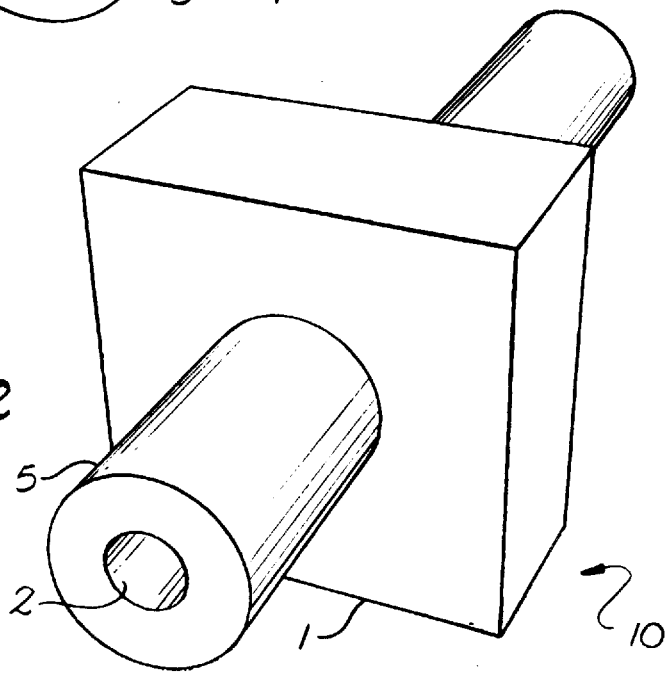
FIG. 2 is a perspective view of an object with a small orifice according to the invention after firing.

In FIG. 2, the casing 1 and ferrule 5 combination has been fired to the required sintering temperature for the required time (e.g., for ceramic inserts, 1450° C. for four hours), and then allowed to cool. Accordingly, because casing 1 is not made from a material having a controlled cross-sectional area, casing 1 and its bore 11 shrink to where gap 9 disappears, or where substantially the entire inner surface 7 of casing 1 is in direct contact with ferrule 5, thus permanently and fixedly securing ferrule 5 within bore 11. Because ferrule 5 is made from a material having a controlled cross-sectional area, neither ferrule 5 nor its orifice 2 change in size during the firing of casing 1 and its subsequent cooling. After the firing and subsequent cooling, casing 1 becomes a support for ferrule 5.

Figure 3A:
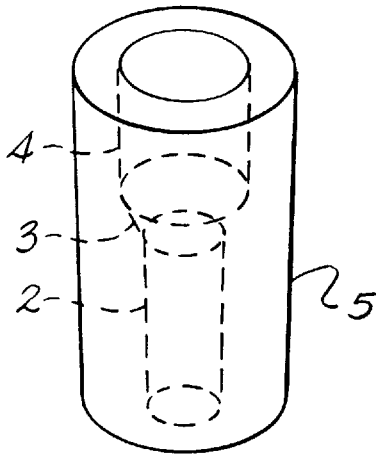
FIGS. 3A–3B are perspective views of an alternative embodiment of an object with a small orifice according to the invention.
Figure 3B:
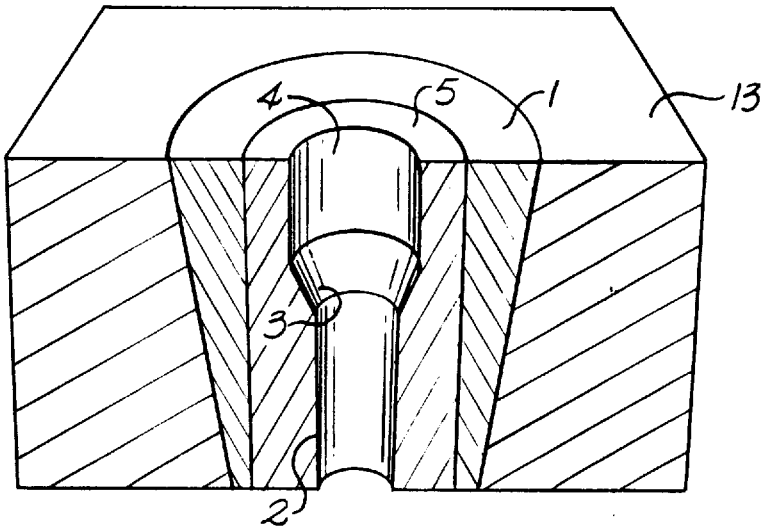

Another embodiment of the present invention is shown in FIGS. 3A, 3B. As shown in FIG. 3A, toughened zirconia ferrule 5 can have a three part bore therethrough. The bore comprises two cylindrical portions, i.e., capillary orifice 2 and counter-bore orifice 4, having different diameters and joined together by a conical transition portion 3. The capillary portion 2 is formed during the extrusion of ferrule 5 to have a diameter of 0.250"–0.300." The green ferrule 5 is then machined so as to form counter-bore 4 and transition 3, since the diameters of these elements are not as critical. Machined ferrule 5 is then placed into a ceramic casing 1 as described above and the combination subjected to the firing and cooling processes, e.g., 1450°–1520° C. for four (4) hours. Finally, as shown in FIG. 3B, the final ferrule 5/casing 1 combination can then be placed into a bore in some other material such as steel, iron, or any other material. This embodiment is envisioned for such uses as the mounting of fuel injectors into cylinder heads where precise amounts of fuel, hence the need for controlled diameter orifices, are required to be injected into engine cylinders made from a metallic material.

Therefore, it is seen that the invention produces an object having a highly precise orifice diameter. It is also seen that the invention produces an object with a highly precise orifice diameter which can be made in an inexpensive and easy manner, thus overcoming the deficiencies of the prior art. Furthermore, it is seen that the invention produces an object that can have the orifice produced prior to firing of the ceramic body.

The above description is given in reference to a ferrule spinneret. However, it is understood that many variations are apparent to one of ordinary skill in the art from a reading of the above specification and such variations are within the spirit and scope of the instant invention as defined by the following appended claims.

That which is claimed:

1. A method of producing an object with a small orifice comprising the steps of:

providing a casing defining a bore therethrough;

providing a ferrule made from a material having a controlled cross-sectional area and defining a spinneret having an orifice therethrough;

placing said ferrule in said bore; and shrinking said casing around said ferrule to securely fix said ferrule in said casing;

whereby the size of said spinneret having said orifice remains constant throughout said step of shrinking;

wherein said spinneret having said orifice maintaining a substantially constant internal diameter.

2. The method according to claim 1 wherein said step of providing a casing further comprises providing a ceramic casing.

3. The method according to claim 2 wherein said step of providing a ceramic casing further comprises providing a non-sintered zirconia casing.

4. The method according to claim 1 wherein said step of shrinking comprises firing said casing.

5. The method according to claim 4 wherein said step of firing said casing further comprises firing said casing at a temperature of 1450° C. for four hours.

6. The method according to claim 1, wherein said steps of providing a casing defining a bore therethrough and providing a ferrule further comprises providing a bore and casing of appropriate sizes for allowing said ferrule to be inserted within said bore with a friction fit.

7. The method according to claim 1 wherein said step of securely fixing said ferrule in said casing further comprises securely fixing said ferrule in said casing such that substantially the entire inner surface of said casing is in direct contact with said ferrule.

8. The method according to claim 1, wherein after said step of firing said casing and said ferrule are inserted inside a bore within another material.

9. The method according to claim 1, wherein said step of providing a ferrule includes the step of forming an orifice through said bore and said step of forming an orifice comprises the steps of:

forming a controlled diameter capillary orifice while extruding said ferrule, therefore forming said spinneret having said orifice therethrough;

machining said extruded ferrule to form a counter-bore orifice and a transition orifice, said transition orifice between said counter-bore orifice and said capillary orifice.

10. The method according to claim 9, wherein said transition orifice tapers from said counter-bore orifice to said capillary orifice, further comprises said capillary orifice having an internal diameter of about 60 to about 200 $\mu$m ±1 $\mu$m, said internal diameter having a tolerance varying no more than 1 $\mu$m.

11. A method of producing an object with a small orifice comprising the steps of:

providing a casing defining a bore therethrough;

providing a ferrule made from a material having a controlled cross-sectional area and defining a spinneret having an orifice therethrough;

shrinking said ferrule;

placing said ferrule in said bore;

allowing said ferrule to expand wherein said ferrule becomes securely fixed within said casing; and maintaining a substantially constant internal diameter of said ferrule defining said spinneret having said orifice throughout said step of shrinking;

wherein said constant internal diameter having a tolerance varying no more than 1 $\mu$m.

12. The method according to claim 11 wherein said step of providing a ferrule further comprises providing a plastic ferrule.

13. The method according to claim 11 wherein said step of shrinking said ferrule further comprises placing said ferrule in liquid nitrogen.

14. The method according to claim 11 wherein said step of allowing said ferrule to expand further comprises allowing said ferrule to expand wherein said ferrule becomes securely fixed within said casing such that substantially the entire inner surface of said casing is in direct contact with said ferrule.

15. An object with a small orifice comprising:

a casing defining a bore therethrough;

a spinneret defining an orifice therethrough, said spinneret being made from a material having a controlled cross-sectional area;

said spinneret being fixedly secured within said bore.

16. The object according to claim 15 wherein said casing is ceramic.

17. The object according to claim 16 wherein said ceramic casing is made from toughened zirconia.

18. The object according to claim 15 wherein said spinneret is fixedly secured within said bore by the firing of said casing and said spinneret.

19. The object according to claim 15 wherein said spinneret is fixedly secured within said bore by pre-shrinking said spinneret and inserting said spinneret into said bore where said spinneret expands to fill said bore.

20. The object according to claim 15 wherein said spinneret has an orifice with a diameter of about 60 to about 200 $\mu$m ±1 $\mu$m.

21. The object according to claim 15 wherein said spinneret is made from a material selected from the group consisting of: lava, steel, titanium, tungsten, polycrystalline ceramics, glass, graphite and plastic.

22. The object according to claim 15 wherein said bore and said spinneret are generally cylindrical, said bore is centered within said casing, and said orifice is centered within said spinneret.

23. The object according to claim 15 wherein said spinneret has a uniform cross-sectional area.

24. The object according to claim 15 wherein said spinneret is fixedly secured within said bore such that substantially the entire inner surface of said casing is in direct contact with said spinneret.

25. The object according to claim 15 wherein said bore and said spinneret are of the appropriate size for allowing said spinneret to be inserted in said bore with a friction fit.

26. The object according to claim 15, wherein said spinneret further comprises:

a controlled diameter capillary orifice;

a counter-bore orifice; and a transition orifice between said capillary and counter-bore orifices.

27. The object according to claim 26, wherein said transition orifice tapers from said counter-bore orifice to said capillary orifice.

28. The object according to claim 27, wherein said capillary orifice is formed during the extrusion of said spinneret and said counter-bore and transition orifices are formed after the extrusion of said spinneret and by machining.

* * * * *